United States Patent [19]

Holmes

[11] Patent Number: 4,479,365

[45] Date of Patent: Oct. 30, 1984

[54] WATER COOLED AIR CONDITIONING AND HEATING ACCESSORY TRANSFER COIL KIT

[76] Inventor: Alan G. Holmes, 8302 Purcell Dr., Orlando, Fla. 32817

[21] Appl. No.: 521,427

[22] Filed: Aug. 8, 1983

[51] Int. Cl.[3] ..... F25B 27/02

[52] U.S. Cl. ..... 62/238.6

[58] Field of Search ..... 62/183, 506, 238.6

[56] References Cited

U.S. PATENT DOCUMENTS

| | | | |
|---|---|---|---|
| 2,142,734 | 1/1939 | Polley | 62/506 X |
| 2,150,993 | 3/1939 | Smith | 62/506 X |
| 2,968,934 | 1/1961 | Komedera | 62/506 X |
| 3,513,663 | 5/1970 | Martin, Jr. et al. | 62/238.6 X |
| 3,992,896 | 11/1976 | Janson et al. | 62/506 X |
| 4,094,167 | 6/1978 | Madsen | 62/238.6 |
| 4,327,561 | 5/1982 | McNeal et al. | 62/238.6 X |
| 4,393,666 | 7/1983 | Revis | 62/506 |

*Primary Examiner*—Lloyd L. King

[57] ABSTRACT

This accessory transfer coil kit is designed to circulate various types of coolants through an air conditioner or heating unit, instead of circulating raw water through such units, which causes corrosion and scale build-up in the existing heat transfer coil of such units. Primarily, the kit consists of an exteriorly mounted coil, which is coupled to the existing coil unit. The kit further includes input and output coolant lines, and a coolant pump, a priming pump, a coolant temperature gauge, expansion pipes, and valves are included, for the efficient operation of the kit, when installed to such existing air conditioners or heating units.

1 Claim, 1 Drawing Figure

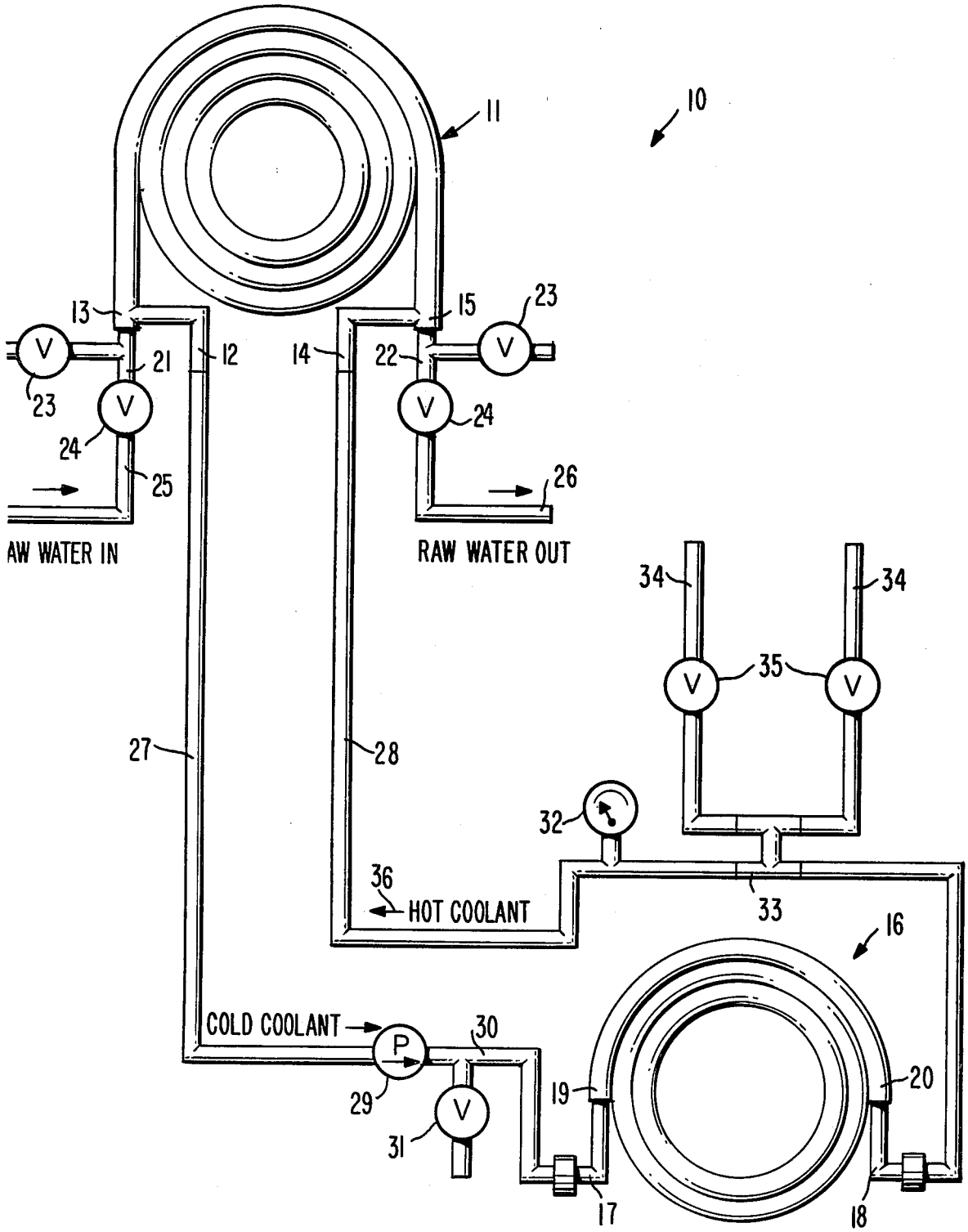
10
11
13
15
23
12
14
21
22
V
23
24
25
26
AW WATER IN
RAW WATER OUT
34
35
27
28
32
36
HOT COOLANT
33
16
COLD COOLANT
P
30
29
31
19
20
17
18

WATER COOLED AIR CONDITIONING AND HEATING ACCESSORY TRANSFER COIL KIT

This invention relates to air conditioners and heating units, and more particularly, to a water cooled air conditioning and heating accessory transfer coil kit.

The principal object of this invention is to provide a water cooled air conditioning and heating accessory transfer coil kit, which will circulate various types of coolants, such as glycol or prestone, through an air conditioner or heating unit, instead of running raw well water through the air conditioner or heating coil of such units, thus preventing rust, corrosion, and scale build-up.

Another object of this invention is to provide a water cooled air conditioner and heating accessory transfer coil kit, which will be employed in air conditioners and heating units, which may even prevent having to replace the entire air conditioner or heating unit, in some instances, because of the abovementioned.

Another object of this invention is to provide a water cooled air conditioner and heating accessory transfer coil kit, which will be so designed, that it will enable only manufactured coolants to circulate through an air conditioner or heat unit's water cooled coil.

A further object of this invention is to provide a water cooled air conditioner and heating accessory transfer coil kit, which will be of such design, that it may be employed for use with all water cooled air conditioners and heating units, and it will serve to prevent periodic chemical cleaning of the abovementioned units by professional servicemen.

A still further object of this invention is to provide a water cooled air conditioner and heating accessory transfer coil kit, which will serve to maintain constantly the efficiency of such air conditioners and heating units, and the transfer coil will be readily accessible, so that, if it fails, it may be easily replaced by a new coil.

An even further object of this invention is to provide a water cooled air conditioner and heating transfer coil kit, which will be so designed, that it will increase the total efficiency of the operation of the air conditioning and heating units, to which it is installed.

Other objects are to provide a water cooled air conditioning and heating accessory transfer coil kit, which is simple in design, inexpensive to manufacture, rugged in construction, easy to use, and efficient in operation.

These, and other objects, will become readily understood, upon a study of the following specification, and the accompanying drawing, which is diagrammatic, and is the sole view of the present invention.

Accordingly, a transfer coil kit 10 is shown to include a suitably wound coil 11, of copper, stainless steel, or other suitable metal, which is provided with a fitting 12 on one end 13, and a similar fitting 14 on its opposite end 15. Coil 10 is installed on the outside of an air conditioner or heating unit, which are not shown, and is similar to the existing coil 16, having fittings 17 and 18 on its ends 19 and 20, which is on the interior of an air conditioner or heating unit. The ends 13 and 15 of coil 10 are also coupled, by fittings 21 and 22, to a pair of flush valves 23, which are coupled to lock-out valves 24, coupled to raw water intake pipe 25, and raw water outlet pipe 26. The raw water intake pipe 25 is connected to the common water supply of the building structure, in which the air conditioner or heating unit is located, and the lock-out valves 24 serve to isolate the transfer coil 10, for easy back flushing, when necessary, and it is to be noted, that fittings 21 and 22 are quick-disconnect types, so as to enable total immersion of transfer coil 10 in a suitable cleaning solution, when necessary. Fitting 12 of coil 10 is coupled to one end of the cold coolant pipe or line 27, and fitting 14 is coupled to one end of the hot coolant pipe or line 28, which is coupled to the existing and normally water cooled coil 16, which is the heat exchanger of the existing air conditioner or heating unit. The opposite end of the cold coolant pipe 27 is suitably coupled to the input side of a coolant circulation pump 29, and the output side of pump 29 is suitably coupled to one end of cold coolant pipe or line 30, having a priming valve 31 therein, for charging the system with a suitable manufactured coolant. The opposite end of pipe 30 is coupled, by fitting 17, to end 19 of coil 16, which is the input side of coil 16, and the opposite end of the hot coolant output pipe or line 28 includes a coolant temperature gauge 32 therein, and is coupled to fitting 18 of the output end 20 of coil 16. The hot coolant pipe 28 also includes a fitting 33 therein, which is between gauge 32 and fitting 18, and is coupled to a pair of expansion air pipes or chambers 34, having lock-out valves 35, and pipes 34 are for priming the manufactured coolant of the system. The lock-out valves 35 are open during the operation of the air conditioner or heating unit.

In use, the existing coil 16 is disconnected from the water supply from pipe 25, and cold coolant pipe 27, together with the hot coolant pipe 28, and pipe 30 are connected to the respective fittings 17 and 18 of the ends 19 and 20 of the coil 16. The opposite ends of pipes 27 and 28 are then coupled to the respective fittings 12 and 14 of the ends 13 and 15 of the coil 11, and lock-out valves 24 are coupled to the water supply inlet pipe 25 and the water outlet pipe 26. The flush valves 23 are then shut off, and the priming valve 31 is then used to charge the system with a suitable coolant. When the air conditioner, to which transfer kit 10 is installed, is in operation, the pump 29 is also in operation, as it is wired into the circuit of the air conditioner. When in operation, the coolant, being pumped by pump 29, causes the coolant in the pipes 27, 28, and 30, to flow in the direction indicated by the arrows 36, so as to circulate through the coil 16 of the air conditioner, thus keeping the coil 16 free of any corrosion or scale build-up therein, while effectively cooling coil 16.

While various changes may be made in the detail construction, it is understood that such changes will be within the spirit and scope of the present invention, as is defined by the appended claims.

What I now claim is:

1. A water cooled air conditioning and heating accessory coil kit, comprising, in combination, an exterior coil, a plurality of valves secured to said exterior coil, and a pair of coolant lines secured to said exterior coil; said exterior coil being of circular wound tubing, and being coupled to the water supply of a building in which the air conditioner or heating unit is located, and is also coupled to the normally water cooled and existing coil of said air conditioner or heating unit; said pair of coolant lines of said exterior coil comprising a cold coolant line suitably coupled to the output side of said exterior coil, and being coupled to the input side of a coolant pump, and the output side of said pump is coupled to a priming valve, which is fixedly secured in a third line suitably coupled, at one end, to the input side of said existing coil, for charging the coolant system of said exterior coil and said existing coil, with a suitable manufactured coolant liquid, and said third line is coupled, at its output end, to the input side of said existing coil, and the output side of said existing coil is coupled to the input side of a hot coolant line, which is the second of said pair, and the input side of said hot coolant line is also suitably coupled to a pair of expansion pipes, a coolant temperature gauge, and to the output side of said exterior coil.

* * * * *